US006926225B1

(12) United States Patent
Powers

(10) Patent No.: US 6,926,225 B1
(45) Date of Patent: Aug. 9, 2005

(54) PLASTIC WRAP DISPENSING APPARATUS

(76) Inventor: Craig J. Powers, 738 Main St., Waltham, MA (US) 02451

( * ) Notice: Subject to any disclaimer, the term of this patent is extended or adjusted under 35 U.S.C. 154(b) by 25 days.

(21) Appl. No.: 10/646,989

(22) Filed: Aug. 22, 2003

(51) Int. Cl.[7] ..... B65H 16/06

(52) U.S. Cl. ..... 242/588.2; 242/598.6; 225/47

(58) Field of Search ..... 242/588.2, 588.6, 242/598.6, 596.3, 391, 405.3; 225/40, 46, 225/47, 48, 49; 156/577, 579

(56) References Cited

U.S. PATENT DOCUMENTS

| | | | | |
|---|---|---|---|---|
| 1,312,713 A | * | 8/1919 | Walsh | 242/588.6 |
| 1,960,850 A | * | 5/1934 | Lloyd | 156/577 |
| 3,423,044 A | * | 1/1969 | Beiderwell | 242/405.3 |
| 4,102,513 A | | 7/1978 | Guard | |
| 4,204,901 A | * | 5/1980 | Hamisch | 156/577 |
| 4,752,045 A | | 6/1988 | Goldstein | |
| 4,817,762 A | | 4/1989 | Powell | 188/67 |
| 5,213,245 A | | 5/1993 | Puaatuua | 225/19 |
| 5,725,726 A | * | 3/1998 | Yu | 156/577 |

FOREIGN PATENT DOCUMENTS

| | | | | |
|---|---|---|---|---|
| DE | 3303640 A1 | * | 8/1984 | 156/577 |

* cited by examiner

*Primary Examiner*—John M. Jillions
(74) *Attorney, Agent, or Firm*—Sturm & Fix LLP

(57) ABSTRACT

An apparatus (10) for dispensing a roll of plastic wrap (100) having a hollow core (101) wherein, the apparatus (10) includes a pair of end cap members (20) each having an axial stub (22) dimensioned to engage the hollow core (101) and a nipple (23) dimensioned to be rotatably received in the end plates (32) having a serrated severing element (35) on one side and a bracket arm (36) on the other side wherein, the bracket arm (36) is adapted to be adjustably engaged in an angular fashion relative to a handle member (40) that is attached to the housing member (30).

12 Claims, 1 Drawing Sheet

PLASTIC WRAP DISPENSING APPARATUS

CROSS REFERENCE TO RELATED APPLICATIONS

This invention was the subject matter of Document Disclosure Program Registration Number 527,651, that was filed in the United States Patent and Trademark Office on Mar. 14, 2003.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of tape dispensers in general and in particular to an apparatus that is adapted to engage and dispense an elongated roll of plastic wrap.

2. Description of Related Art

As can be seen by reference to the following U.S. Pat. Nos. 5,213,245; 4,102,513; 4,752,045; and 4,817,762; the prior art is replete with myriad and diverse devices designed to dispense elongated rolls of plastic wrap.

While all of the aforementioned prior art constructions are more than adequate for the basic purpose and function for which they have been specifically designed, they are uniformly deficient with respect to their failure to provide a simple, efficient, and practical plastic wrap dispenser apparatus having an angularly adjustable handle.

Unfortunately, most of the prior art constructions are either axially aligned with the hollow core of the roll of plastic wrap or employ a yoked handle that is awkward to manipulate particularly when employed to perform multiple plastic wrap covering procedures.

As a consequence of the foregoing situation, there has existed a longstanding need for a new and improved plastic wrap dispensing apparatus that simplifies the task of dispensing plastic wrap while eliminating the tendency of the trailing edges of the plastic wrap from folding over on themselves; and the provision of such a construction is a stated objective of the present invention.

BRIEF SUMMARY OF THE INVENTION

Briefly stated, the plastic wrap dispensing apparatus that forms the basis of the present invention comprises in general an adapter unit, a housing unit and an angularly adjustable handle unit.

As will be explained in greater detail further on in the specification, the adapter unit includes a pair of end cap members adapted to frictionally engage the opposite ends of the core of the roll of plastic wrap wherein each end cap member is provided with an outwardly projecting nipple.

The housing unit in turn comprises an elongated arcuate trough the opposite ends of which are provided with end plates having an apertured portion dimensioned to rotatably receive the nipples on the end cap member.

Furthermore, one side of the trough is provided with a serrated severing element and the other side of the trough is adapted to be connected to the handle unit in an angularly adjustable fashion.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 3:
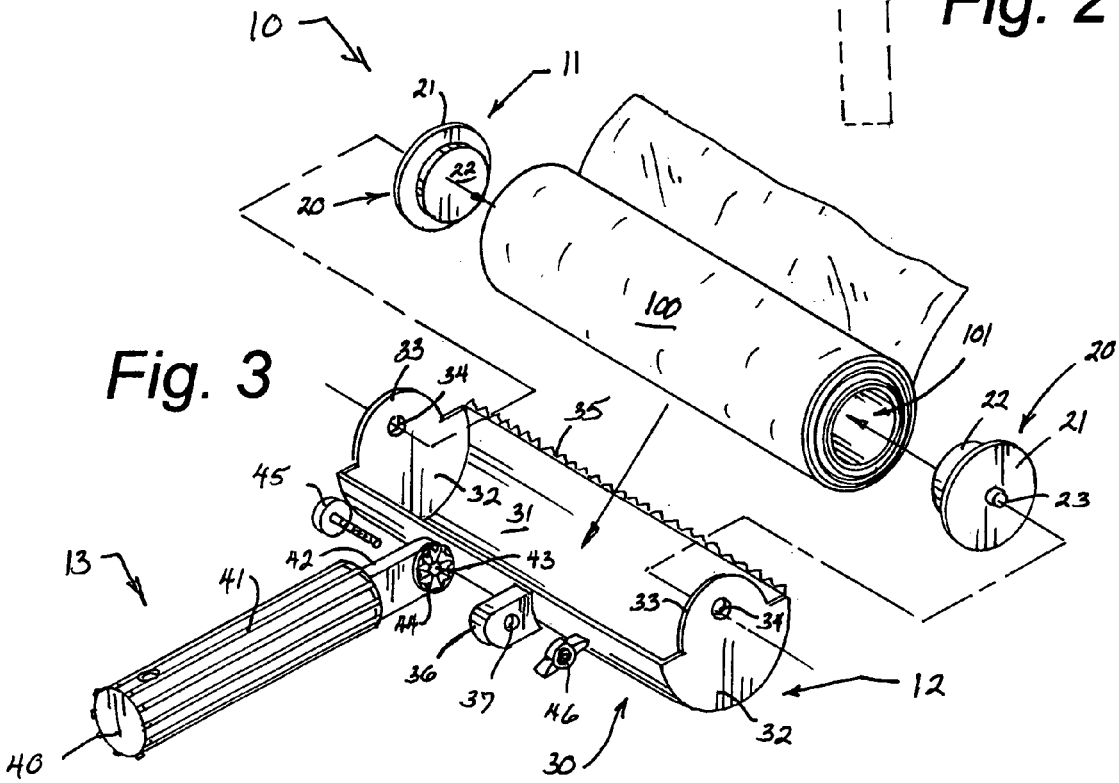
FIG. 3 is an exploded perspective view of the dispensing apparatus.

As can be seen by reference to the drawings, and in particularly to FIG. 3, the plastic wrap dispensing apparatus that forms the basis of the present invention is designated generally by the reference number 10. The apparatus 10 comprises in general an adaptor unit 11, a housing unit 12, and an angularly adjustable handle unit 13. These units will now be described in seriatim fashion.

As shown in FIG. 3, the adaptor unit 11 comprises a pair of end cap members 20 20 wherein each end cap member 20 includes a disk shaped flange 21 having a short cylindrical axle stub 22 centrally disposed on one flange face and a discrete cylindrical nipple 23 centrally disposed on the opposed flange face wherein, the axle stub 22 is dimensioned to be frictionally engaged in one end of the hollow cylindrical core 101 of a roll of plastic wrap 100.

In addition, the housing unit 12 comprises a housing member 30 having an elongated trough 31 having a generally semi-circular cross sectional configuration wherein, the opposite ends of the trough 31 are provided with semi-circular end panels 32 each having an arcuate raised tab element 33 projecting upwardly therefrom wherein, the tab elements 33 33 are each provided with a discrete aperture 34 dimensioned to rotatably receive the cylindrical nipples 23 23 on the end cap members 20 20.

As can also be seen by reference to FIG. 3, the distal edge of the trough 31 is provided with a serrated severing element 35 and the proximal portion of the trough 31 is provided with a generally centrally disposed bracket arm 36 having a central aperture 37 formed thereon for reasons that will be explained presently.

Figure 1:
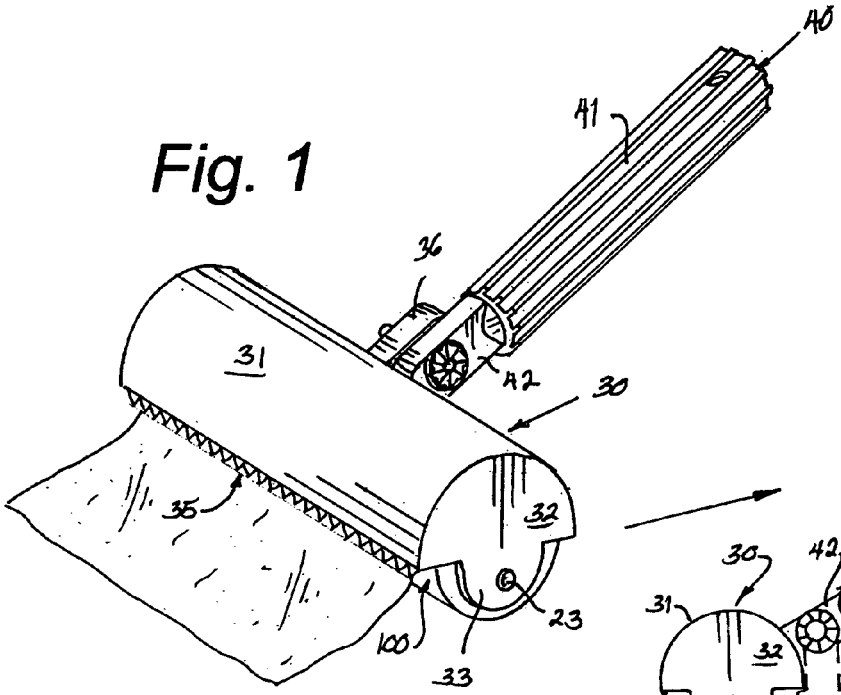
FIG. 1 is a perspective view of the plastic wrap dispensing apparatus that forms the basis of the present invention.

Turning now to FIGS. 1 and 3, it can be seen that the handle unit 13 comprises an elongated generally cylindrical handle member 40 having a ribbed periphery 41 wherein, the inboard end of the handle member 40 terminates in a generally flat extension arm 42 having an aperture 43 surrounded by a radial toothed arrangement 44 that is adapted to cooperate with a complimentary toothed arrangement (not shown) that surrounds the central aperture 37 of the bracket arm 36 of the housing member in a well recognized fashion when the extension arm 42 is attached to the bracket arm 36 via conventional fastening elements 45 46.

In operation, the user would remove the roll of plastic wrap 100 from its container and then insert the cap members

20 20 into the opposite ends of the hollow core 101. Then, given the fact that the end panels 32 of the housing member 30 are flexible, the nipples 23 on the cap members 20 20 can be inserted through the apertures 34 34 of the housing member 30 to rotatably support the roll of plastic wrap 100 within the housing member 30.

Figure 2:
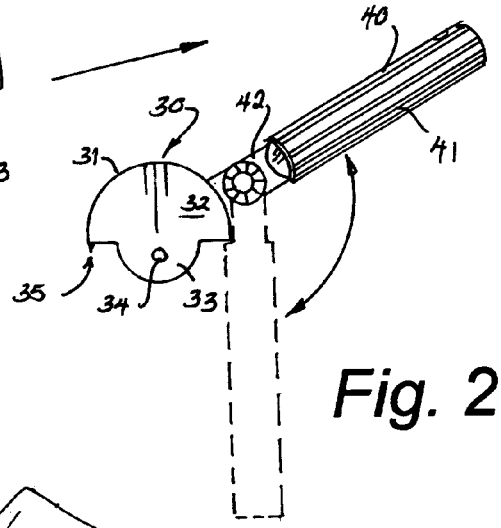
FIG. 2 is a side elevation view of the dispensing apparatus.

Furthermore, the radial toothed arrangement 44 on the handle extension arm 42 and the housing bracket arm 36 allows the handle member 40 to be angularly adjustable relative to the housing member 30 as depicted in FIG. 2.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A dispenser apparatus for a roll of plastic wrap having a hollow core wherein, the apparatus comprises an adaptor unit including a pair of end cap members each having a short axial stub dimensioned to frictionally engage the opposite ends of the hollow core of the roll of plastic wrap a housing unit including an elongated housing member having an arcuate trough the opposite ends of which are provided with end panels first means for suspending the end cap members from a portion of the housing member a handle unit including an elongated handle member having a distal end and, second means for attaching the distal end of the handle member to the intermediate portion of said arcuate trough.

2. The apparatus as in claim 1; wherein, said second means is further adapted to angularly adjust the orientation of the handle member relative to the housing member.

3. The apparatus as in claim 1; wherein, one edge of the arcuate trough is provided with a serrated severing element.

4. The apparatus as in claim 2; wherein, one edge of the arcuate trough is provided with a serrated severing element.

5. The apparatus as in claim 1; wherein, each of the end cap members is further provided with an outwardly projecting cylindrical nipple and, each of the end plates of the housing member is provided with a portion having an aperture dimensioned to receive one of the nipples.

6. The apparatus as in claim 4; wherein, each of the end cap members is provided with an outwardly projecting cylindrical nipple; and, each of the end plates of the housing member is provided with a portion having an aperture dimensioned to receive one of the nipples.

7. The apparatus as in claim 5; wherein, the handle member is provided with an extension arm having an aperture and one side of the trough is provided proximate the midpoint of the trough with a bracket arm having an aperture.

8. The apparatus as in claim 6; wherein, the handle member is provided with an extension arm having an aperture and one side of the trough is provided proximate the midpoint of the trough with a bracket arm having an aperture.

9. The apparatus as in claim 7; wherein, the apertures in the extension arm and the extension bracket are dimensioned to receive conventional fasteners to secure the handle member to the housing member.

10. The apparatus as in claim 9; wherein, the apertures in said extension arm and said extension bracket are provided with radial toothed arrangements that frictionally engage one another.

11. The apparatus as in claim 8; wherein, the apertures in the extension arm and the extension bracket are dimensioned to receive conventional fasteners to secure the handle member to the housing member.

12. The apparatus as in claim 10; wherein, the apertures in the extension arm and the extension bracket are dimensioned to receive conventional fasteners to secure the handle member to the housing member.

* * * * *